US006895618B2

(12) United States Patent
Jährling

(10) Patent No.: US 6,895,618 B2
(45) Date of Patent: May 24, 2005

(54) TABLE TOP FOR A PATIENT TROLLEY WITH AN ARMREST

(75) Inventor: Peter Jährling, Puschendorf (DE)

(73) Assignee: Siemens Aktiengesellschaft, Münich (DE)

( * ) Notice: Subject to any disclaimer, the term of this patent is extended or adjusted under 35 U.S.C. 154(b) by 0 days.

(21) Appl. No.: 10/630,087

(22) Filed: Jul. 30, 2003

(65) Prior Publication Data

US 2004/0049851 A1 Mar. 18, 2004

(30) Foreign Application Priority Data

Jul. 31, 2002 (DE) ..... 102 34 982

(51) Int. Cl.[7] ..... A61G 13/12
(52) U.S. Cl. ..... 5/623; 5/646; 5/425; 5/658
(58) Field of Search ..... 5/623, 621, 646, 5/424, 425, 503.1, 658, 662

(56) References Cited

U.S. PATENT DOCUMENTS

| | | | | | |
|---|---|---|---|---|---|
| 2,678,857 | A | * | 5/1954 | Hans | 5/636 |
| 2,766,463 | A | * | 10/1956 | Bendersky | 5/623 |
| 2,872,259 | A | * | 2/1959 | Thorpe | 5/613 |
| 3,434,165 | A | * | 3/1969 | Keane | 5/608 |
| 3,829,079 | A | * | 8/1974 | Fox | 5/621 |
| 3,873,081 | A | * | 3/1975 | Smith | 5/621 |
| D264,875 | S | * | 6/1982 | Crocker | D24/183 |
| 4,688,780 | A | * | 8/1987 | Hanz | 5/621 |
| 5,096,173 | A | * | 3/1992 | Yamashita et al. | 5/621 |
| 5,289,603 | A | * | 3/1994 | Kumagai | 5/621 |
| 5,353,809 | A | * | 10/1994 | Faucher | 5/646 |
| 5,360,392 | A | * | 11/1994 | McCoy | 602/6 |
| 5,484,393 | A | * | 1/1996 | McCoy | 602/6 |
| 5,742,962 | A | * | 4/1998 | Yoshino et al. | 5/623 |
| 6,023,800 | A | | 2/2000 | Stickley | 5/621 |
| 2003/0167569 | A1 | * | 9/2003 | Newkirk et al. | 5/613 |
| 2004/0049851 | A1 | * | 3/2004 | Jahrling | 5/623 |

FOREIGN PATENT DOCUMENTS

FR 001454018 A * 9/1966

* cited by examiner

*Primary Examiner*—Robert G. Santos
(74) *Attorney, Agent, or Firm*—Schiff Hardin LLP

(57) ABSTRACT

A table top for a patient trolley or gurney is provided with a removable armrest. The armrest is mounted on the table top by having an insertion piece received in an insertion opening on the edge of the table top. In the preferred embodiment, the table top has a plurality of insertion openings in the form of slots spaced along the edge of the table and the armrest has two sets of insertion pieces, with each set having a pair of insertion pieces extending at right angles to each other, so that the armrest can be mounted extending vertically relative to the plane of the table top or parallel to the plane of the table top.

15 Claims, 3 Drawing Sheets

TABLE TOP FOR A PATIENT TROLLEY WITH AN ARMREST

BACKGROUND OF THE INVENTION

The present invention is directed to a table top for a patient trolley or gurney which has an armrest.

U.S. Pat. No. 6,023,800 A1, whose disclosure is incorporated herein by reference thereto, discloses a removable carrier for accessories for a patient positioning table. The carrier primarily comprises a vise, upon which is mounted a rail to accept the accessories, for example an armrest. However, such armrests are very complicated and difficult to attach to this device, which, in turn, is detachably connected on the edge of the positioning table.

SUMMARY OF THE INVENTION

The present invention is directed to the object of providing a table top, for example for a patient trolley, which has an armrest that has versatile uses and can be attached easily and without problems. These objects are achieved by an armrest which is provided with insertion pieces, such as tabs or tongues, arranged angularly that can be inserted into at least one of the insertion openings on the edge of the table top. The armrest can then be arranged in various angular positions with regard to the plane of the table top.

It has been found to be advantageous when the insertion pieces or insertion tabs or tongues, which have a right angle profile and the accepting insertion opening is an insertion slot in the table. The armrest can be arranged in various positions with regard to the length of the table top when the table top has a plurality of insertion openings that are arranged in a row at identical spacings from one another. The armrest can be provided with grip holes in an advantageous manner so that a patient trolley or gurney can be easily moved and directed during movement.

It has been found to be advantageous when two insertion pieces of the armrest fashioned as a pair are arranged at right angles and when one of the insertion pieces exhibits the same orientation as the surface of the armrest.

The armrest can be securely held when two insertion pieces of the armrest form a pair and when two pairs are arranged in the armrest, whereby the distance of the insertion openings has the same spacing as the distance between the pair of insertion pieces or tabs.

Other advantages and features of the invention will be readily apparent from the following description, the claims and drawings.

DESCRIPTION OF THE PREFERRED EMBODIMENTS

Figure 1:
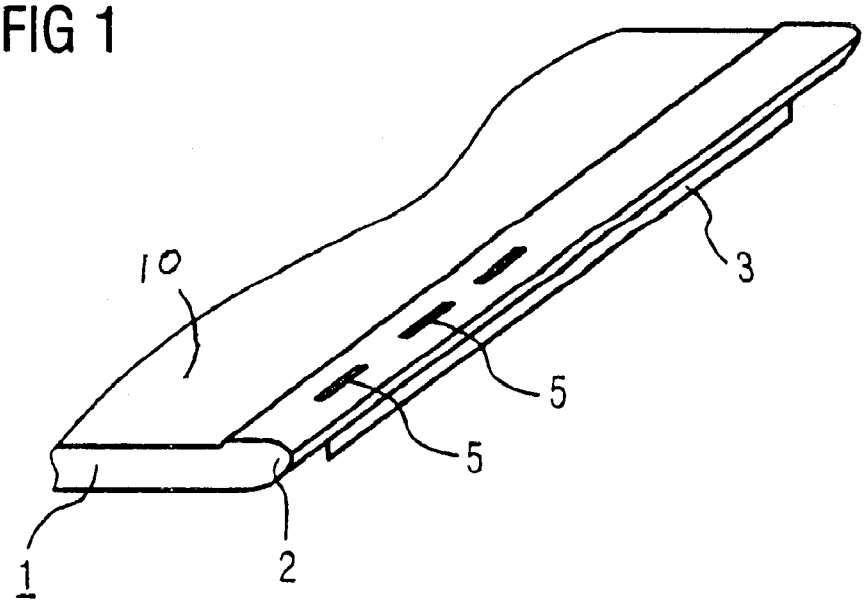
FIG. 1 is a partial perspective view of an edge of a table top in accordance with the present invention.
Figure 4:
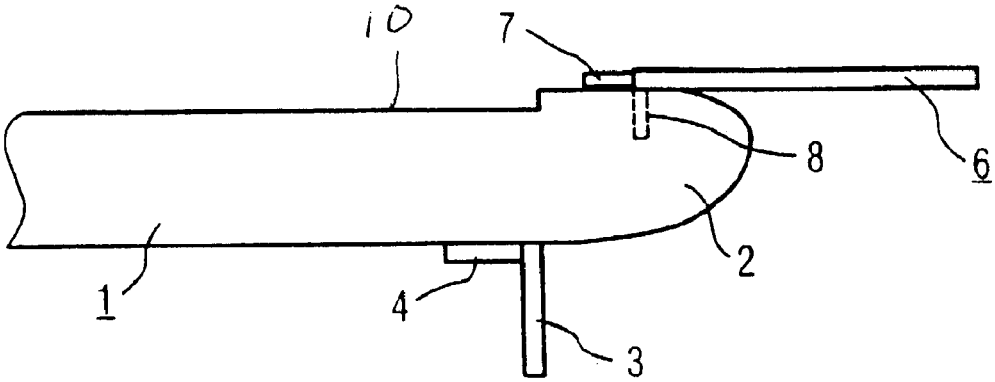
FIG. 4 is a partial end view of the table top of FIG. 1 with the armrest inserted so that the armrest extends in a plane parallel to the plane of the surface of the table top.
Figure 5:
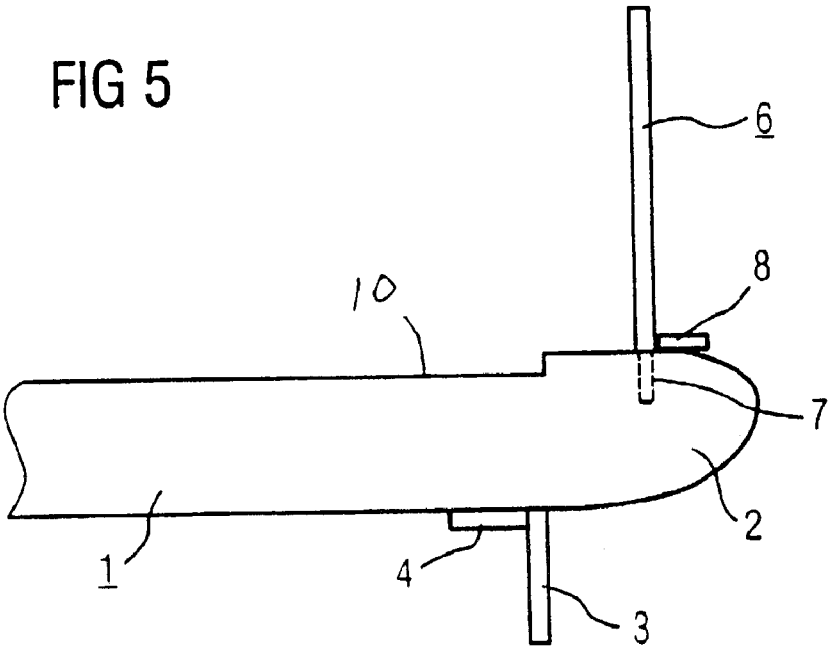
FIG. 5 is a partial end view of the table top of FIG. 1 with the armrest inserted to be extending in a plane at right angles to the surface of the table top.

The principles of the present invention are particularly useful when incorporated in an armrest 6, which is detachably mounted on a table top 1 shown in FIGS. 1, 4 and 5.

As illustrated in FIG. 1, the table top 1 has an edge profile 2 at its edge that is provided with a longitudinal guide 3 and a spacer or brace 4 (see FIGS. 4 and 5) to increase the rigidity of the edge of the table. Along the edge profile 2, a plurality of insertion slots 5 are provided on an upper surface 10 of the table top 1 at an equal spacing along the edge. As shown, these can only be distributed in the area of the arms or additionally over the entire length of the edge profile 2.

Figure 2:
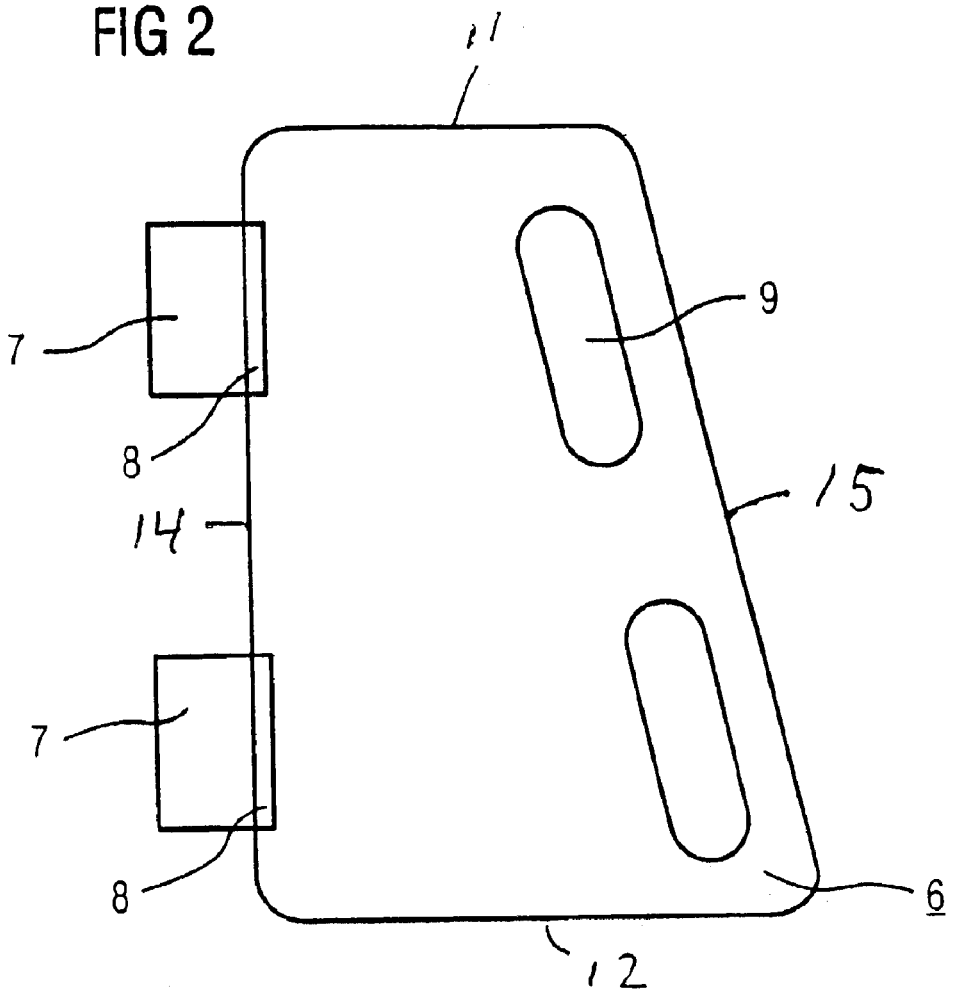
FIG. 2 is a bottom plan view of an armrest in accordance with the present invention.
Figure 3:
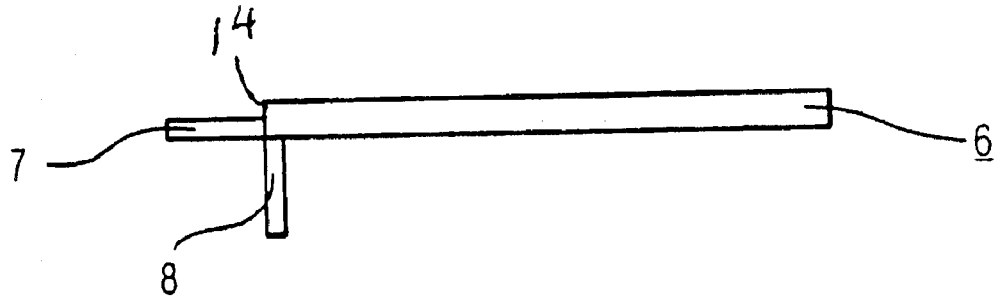
FIG. 3 is an end view taken from the upper end of the armrest of FIG. 2.

An armrest 6 shown in FIG. 2 has a shape of a trapezoid with a pair of parallel-extending ends 11 and 12 and two sides 14 and 15. As shown in FIGS. 2 and 3, the armrest 6 includes a horizontal insertion tab or tongue 7, which extends in the plane of the armrest 6 from the side 14, and a vertical insertion tab or tongue 8, which extends at right angles to the plane of the armrest 6. The tabs or tongues 7 and 8 form a pair of tabs and the armrest is illustrated as having two sets of these pairs of tabs. In addition to the pairs of tabs or tongues on the one edge or side 14 of the armrest, the armrest is furnished with grip holes 9 adjacent an opposite edge or side 15. These grip holes can be gripped by a person moving the trolley or gurney to aid in controlling the movement of the gurney with a patient on the table top 1.

As illustrated in FIG. 4, the armrest 6 is mounted on the table top by having the tabs or tongues 8 inserted in the slots 5 and, thus, the armrest 6 will lie in a plane substantially parallel to the plane of the upper surface 10 of the table top 1. This position is the horizontal position and is obtained when the vertically-extending tabs 8 are in the holes 5.

The armrest 6 illustrated in FIG. 5 has been mounted with the tabs 7 received in the slots, so that the plane of the armrest extends substantially at right angles to the plane of the top or upper surface 10 of the table top 1. This serves the purpose of holding the patient on the table top during transport and, as mentioned above, the openings 9 can be gripped by the person moving the gurney to provide better control of the movement.

As illustrated in FIG. 1, three slots are provided on the edge of the table top, so that the armrest can assume, in addition to the horizontal and vertical positions, a position along the length or edge of the table top. By providing additional openings or slots 5, additional positions along the length of the table top are available.

Like the table top 1, the armrest can be formed of a carbon fiber material; however, other material can also be considered. The same is also true for the insertion tabs 7 and 8.

Although various minor modifications may be suggested by those versed in the art, it should be understood that I wish to embody within the scope of the patent granted hereon all such modifications as reasonably and properly come within the scope of my contribution to the art.

I claim:

1. A table top for a patient gurney having an armrest, said armrest being provided with insertion pieces, which can be inserted into at least one insertion opening provided on the edge of the table top, said insertion pieces forming at least one pair with the insertion pieces of the at least one pair being respectively disposed on intersecting faces of said armrest so that said insertion pieces are angularly arranged to each other.

2. A table top according to claim 1, wherein the insertion pieces of the pair are insertion tabs extending at a right angle to each other and the receiving insertion opening is an insertion slot.

3. A table top according to claim 2, wherein the table top has a plurality of insertion openings that are arranged in a row at an equal distance from one another along the edge of the table top.

4. A table top according to claim 3, wherein the armrest is provided with grip holes.

5. A table top according to claim 4, wherein the armrest has two pairs of insertion pieces arranged on the armrest at a distance equal to the distance between the insertion openings on the table top.

6. A table top according to claim 5, wherein one of the insertion pieces of each pair exhibits the same orientation as the surface of the armrest.

7. A table top according to claim 1, which includes a plurality of insert openings which are arranged in a row at equal spacing from one another along the edge of the table top.

8. A table top according to claim 7, wherein the armrest has two pairs of these insertion pieces spaced apart at a distance equal to the spacing between insertion openings on the table top.

9. A table top according to claim 8, wherein the two insertion pieces of the armrest forming each pair are arranged at right angles to each other, with one of the insertion pieces having the same orientation as the surface of the armrest.

10. A table top according to claim 1, wherein the armrest is provided with grip holes.

11. A table top according to claim 1, wherein the insertion pieces of each pair extend at right angles to each other, at least one of the insertion pieces of each pair extends in a plane which is parallel to a plane of the armrest.

12. A table top according to claim 11, wherein the armrest is provided with grip holes.

13. A table top according to claim 1, wherein the armrest has two pairs of insertion pieces arranged on the armrest at a distance equal to the distance between the insertion openings on the table top.

14. A table top according to claim 13, wherein the table top has more than two insertion openings which are arranged in a row at equal spacing from one another along the edge of the table top.

15. A table top for a patient gurney having an armrest, said table top having at least one insertion opening provided on an edge of the table top, said armrest being provided with at least a pair of insertion pieces being respectively disposed on intersecting faces of said armrest so that said insertion pieces are angularly arranged to each other, one of the insertion pieces of the pair being inserted into the insertion opening to position the armrest in a first position on the table top and the other insertion piece of the pair being inserted in the insertion opening to position the armrest in a second position on the table top at an angle to the first position.

* * * * *